US010190782B2

(12) United States Patent
Moon et al.

(10) Patent No.: US 10,190,782 B2
(45) Date of Patent: Jan. 29, 2019

(54) GAS OVEN

(71) Applicant: Samsung Electronics Co., Ltd., Suwon-si (KR)

(72) Inventors: Byoung Hoon Moon, Gyeonggi-do (KR); Byoung Jun Choi, Gyeonggi-do (KR); Sun Woo Han, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 226 days.

(21) Appl. No.: 14/988,635

(22) Filed: Jan. 5, 2016

(65) Prior Publication Data

US 2016/0195283 A1 Jul. 7, 2016

(30) Foreign Application Priority Data

Jan. 5, 2015 (KR) ..... 10-2015-0000921

(51) Int. Cl.
*F24C 15/32* (2006.01)
*F24C 3/08* (2006.01)
*F24C 3/00* (2006.01)

(52) U.S. Cl.
CPC ..... *F24C 15/322* (2013.01); *F24C 3/004* (2013.01); *F24C 3/087* (2013.01)

(58) Field of Classification Search
None
See application file for complete search history.

(56) References Cited

U.S. PATENT DOCUMENTS 1,169,694 A * 1/1916 Swisher ..... F24C 15/2007 126/21 R
2,511,328 A * 6/1950 Cline ..... F24C 15/2007 126/21 A
3,063,441 A * 11/1962 Stoligrosz ..... F24C 3/047 126/21 A
3,384,068 A 5/1968 Perry et al.
3,463,138 A * 8/1969 Lotter ..... A21B 1/02 126/21 A (Continued)

FOREIGN PATENT DOCUMENTS

CN 1479044 A 3/2004
CN 1888547 A 1/2007

(Continued)

OTHER PUBLICATIONS

Extended European Search Report dated May 9, 2016 in connection with European Application No. 16150175.4, 7 pages.

(Continued)

*Primary Examiner* — Avinash Savani
*Assistant Examiner* — Martha Becton

(57) ABSTRACT

Disclosed herein is a gas oven including a body, a cooking space formed in the body, an air supply flow channel configured to connect the cooking space with an outside of the body to supply air to the cooking space, and a distribution unit configured to distribute or bend the air supplied through the air supply flow channel to supply the air to the cooking space. Through the distribution unit, it is possible to smoothly supply a primary air for mixing with gas and to smoothly supply a secondary air to an inside of the cooking space.

19 Claims, 17 Drawing Sheets

(56) References Cited

U.S. PATENT DOCUMENTS 3,590,805 A * 7/1971 Perl ..... F24C 3/027 126/21 A
3,698,377 A * 10/1972 Smith ..... F24C 15/322 126/21 A
3,812,838 A * 5/1974 Mutchler ..... F24C 15/322 126/21 A
3,973,551 A * 8/1976 Caselani ..... A21B 1/28 126/21 A
4,671,250 A * 6/1987 Hurley ..... F24C 15/322 126/21 A
4,726,766 A * 2/1988 Stewart ..... A21B 1/26 126/21 A
4,846,647 A * 7/1989 Stewart ..... A21B 1/26 110/162
5,203,315 A * 4/1993 Clawson ..... F24C 3/087 126/19 R
5,235,962 A * 8/1993 Doty ..... F24C 15/006 126/198
5,816,234 A * 10/1998 Vasan ..... F24C 15/322 126/21 A
7,784,457 B2 * 8/2010 Akdag ..... F24C 15/322 126/21 A
8,991,383 B2 * 3/2015 Johnson ..... F24C 15/16 126/21 A
9,157,640 B2 * 10/2015 Distaso ..... F24C 15/2007
2006/0137675 A1 * 6/2006 Kim ..... F24C 15/001 126/21 A
2008/0067167 A1 3/2008 Sung et al.
2008/0149088 A1 * 6/2008 Inada ..... F24C 15/327 126/21 R
2009/0013987 A1 * 1/2009 Akdag ..... F24C 15/322 126/21 A
2010/0139641 A1 * 6/2010 Distaso ..... F24C 15/2007 126/21 R
2011/0132350 A1 * 6/2011 Ryu ..... F24C 3/087 126/39 E
2012/0125313 A1 * 5/2012 Van Der Weij ..... A47J 37/0641 126/21 R
2013/0291854 A1 * 11/2013 Johnson ..... F24C 15/16 126/21 A
2014/0144422 A1 * 5/2014 Wie ..... F24C 3/087 126/39 E
2014/0144423 A1 * 5/2014 Wie ..... F24C 15/322 126/39 E
2014/0174426 A1 * 6/2014 Moon ..... F24C 15/322 126/21 A
2015/0000539 A1 * 1/2015 Tcaciuc ..... F24C 15/322 99/447
2015/0107576 A1 * 4/2015 Jeong ..... F24C 3/087 126/39 C
2015/0192307 A1 * 7/2015 Paller ..... F24C 15/322 126/273 R
2015/0285509 A1 * 10/2015 Wie ..... F24C 3/004 126/273 R
2015/0285510 A1 * 10/2015 Wie ..... F24C 3/025 126/273 R
2015/0285514 A1 * 10/2015 Wie ..... F24B 1/02 126/21 A
2016/0195282 A1 * 7/2016 Kim ..... F24C 3/087 126/21 A

FOREIGN PATENT DOCUMENTS

CN 101147653 A 3/2008
CN 103876645 A 6/2014
EP 2746669 A2 6/2014

OTHER PUBLICATIONS

Communication under Rule 71(3) EPC regarding Application No. 16150175.4, dated Jun. 13, 2018, 7 pages.

Communication from a foreign patent office in a counterpart foreign application, State Intellectual Property Office of the People's Republic of China, "The First Office Action," Application No. CN201610107478.3, dated Nov. 2, 2018, 16 pages.

* cited by examiner

GAS OVEN

CROSS-REFERENCE TO RELATED APPLICATIONS AND CLAIM OF PRIORITY

The present application is related to and claims benefit of Korean Patent Application No. 10-2015-0000921, filed on Jan. 5, 2015 in the Korean Intellectual Property Office, the disclosure of which is incorporated herein by reference.

TECHNICAL FIELD

Embodiments of the present disclosure relate to a gas oven, and more particularly, to a gas oven with an improved air supply structure.

BACKGROUND

Gas ovens are home appliances that include a cooking space in which an ingredient is accommodated, a burner that generates heat by burning gas and air, a gas supply flow channel through which gas is supplied to the burner, and an igniter that generates flames and heats the ingredient accommodated in the cooking space at a high temperature to cook.

As well known, since air is necessary to produce combustion, and combustion gas that is waste gas occurring after the combustion is produced, gas ovens further include an air supply flow channel for supplying the air to a cooking space and an air discharge flow channel for discharging the waste gas.

The air supply flow channel and the air discharge flow channel connect an inside of the cooking space with an outside of a body, respectively. Here, since warm air rises and cold air falls due to a difference in densities, the air supply flow channel is provided to be connected to a bottom of the cooking space and the air discharge flow channel is provided to be connected to a top of the cooking space.

SUMMARY

To address the above-discussed deficiencies, it is a primary object to provide a gas oven capable of smoothly supplying air into a cooking space of the gas oven.

It is another aspect of the present disclosure to provide a gas oven capable of smoothly supplying primary air and secondary air necessary for combustion of the gas oven.

Additional aspects of the disclosure will be set forth in part in the description which follows and, in part, will be obvious from the description, or may be learned by practice of the disclosure.

In accordance with one aspect of the present disclosure, a gas oven includes a body, a cooking space formed in the body, a burner provided in the cooking space, an air supply flow channel configured to connect the cooking space with an outside of the body to supply air to the cooking space, and a distribution unit provided at an ejection portion of the air supply flow channel and configured to distribute the air supplied through the air supply flow channel. Here, the distribution unit includes a distribution guide portion configured to distribute the air supplied through the air supply flow channel and a supply guide portion configures guide the air that passes through the distribution guide portion to be supplied to one of the cooking space and the burner.

The air supplied through the air supply flow channel may pass through the distribution guide portion and may be discharged outside the distribution unit through the supply guide portion.

The distribution unit may be disposed in an ejection direction of the ejection portion of the air supply flow channel so as to not expose the ejection portion to the cooking space.

The gas oven may include an inner wall configured to form the cooking space therein, and on which the ejection portion of the air supply flow channel and the distribution unit are disposed. Here, the distribution unit may be provided to bend a flow of the air supplied through the air supply flow channel to supply the air to the cooking space along the inner wall.

The supply guide portion may be formed on the inner wall along the whole circumference of the distribution guide portion.

The distribution guide portion may include a distribution portion configured to distribute the air supplied through the air supply flow channel and a guide portion provided adjacent to the distribution portion and configured to guide the air distributed from the distribution portion.

The gas oven may include an inner wall configured to form the cooking space therein, on which the ejection portion of the air supply flow channel and the distribution unit are disposed. Here, the distribution portion may be formed closer to the inner wall than the guide portion.

The guide portion may include a first guide portion disposed on one side of the distribution portion, is disposed closer to a bottom surface of the cooking space than the distribution portion, and configured to form a first guide flow channel in a longitudinal direction parallel to the bottom surface of the cooking space.

The guide portion may further include a second guide portion disposed on the other side of the distribution portion and configured to form a second guide flow channel to be connected with the supply portion.

An inner surface of the distribution guide portion may be formed to be curved to reduce pneumatic resistance of the air that passes through an inside of the distribution guide portion.

The supply guide portion may include a supply portion provided on one side of the distribution guide portion and configured to eject allow air that is mixed with gas that flows into the burner, and an overflow portion formed along part of a circumference of the distribution guide portion and configured to eject air to the cooking space.

The supply portion may be formed to extend from the distribution guide portion and to be spaced at certain intervals along a circumference of a head portion of the burner.

The gas oven may include an inner wall configured to form the cooking space therein. Here, the overflow portion may include an overflow gap formed to be spaced at a certain interval from the inner wall and may be formed along the circumference of the distribution guide portion.

The overflow portion may further include an overflow rib formed along an outer edge of the overflow portion to be bent toward the inner wall.

The supply guide portion may include a supply portion provided on one side of the distribution guide portion and configured to eject air that is mixed with gas that flows into the burner, and an overflow portion formed along at least a part of a circumference of the distribution guide portion and configured to eject air to the cooking space. Here, the overflow portion may include a first overflow portion formed along at least part of a circumference of the first guide portion and a second overflow portion formed along at least part of a circumference of the second guide portion.

The cooking space may include a first separate cooking space on top and a second separate cooking space on bottom, and may be provided to be dividable into the first separate cooking space and the second separate cooking space by a divider. Here, the burner may include a first burner provided in the first separate cooking space and a second burner provided in the second separate cooking space. Here, the air supply flow channel may include a second air supply flow channel configured to connect the second separate cooking space with the outside of the body and to supply air to the second separate cooking space and a first air supply flow channel configured to connect the first separate cooking space with the outside of the body to supply air to the first separate cooking space. Here, the distribution unit may be disposed at the ejection portion of the first air supply flow channel.

In accordance with another aspect of the present disclosure, a gas oven includes a body, one cooking space dividable into a first separate cooking space on top and a second separate cooking space on bottom by a divider separably mounted in the one cooking space, one door configured to open and close the cooking space, a second air supply flow channel configured to connect the second separate cooking space with an outside of the body to supply air to the second separate cooking space, and a first air supply flow channel configured to connect the first separate cooking space with the outside of the body to supply air to the first separate cooking space.

The gas oven may include a first burner provided in the first separate cooking space and a distribution unit provided at an ejection portion of the first air supply flow channel and configured to distribute the air supplied from the first air supply flow channel that is mixed with gas supplied to the first burner or ejected to an inside of the first separate cooking space.

The distribution unit may include a distribution guide portion configured to distribute the air supplied through the first air supply flow channel and a supply guide portion configured to guide the air that passes through the distribution guide portion to supply the air to one of the cooking space and the first burner.

The air supplied through the air supply flow channel may pass through the distribution guide portion and may be discharged outside the distribution unit through the supply guide portion.

The distribution unit may be disposed in an ejection direction of the ejection portion of the first air supply flow channel so as to not expose the ejection portion to the cooking space.

The gas oven may include an inner wall configured to form the cooking space therein, and on which the ejection portion of the first air supply flow channel and the distribution unit are disposed. Here, the distribution unit may be configured to bend a flow of the air supplied through the first air supply flow channel to supply the air to the cooking space along the inner wall.

The supply guide portion may be formed on the inner wall along the whole circumference of the distribution guide portion.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which: For a more complete understanding of the present disclosure and its advantages, reference is now made to the following description taken in conjunction with the accompanying drawings, in which like reference numerals represent like parts.

DETAILED DESCRIPTION

FIGS. 1 through 17, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. Hereinafter, embodiments of the present disclosure will be described in detail with reference to the attached drawings.

Figure 1:
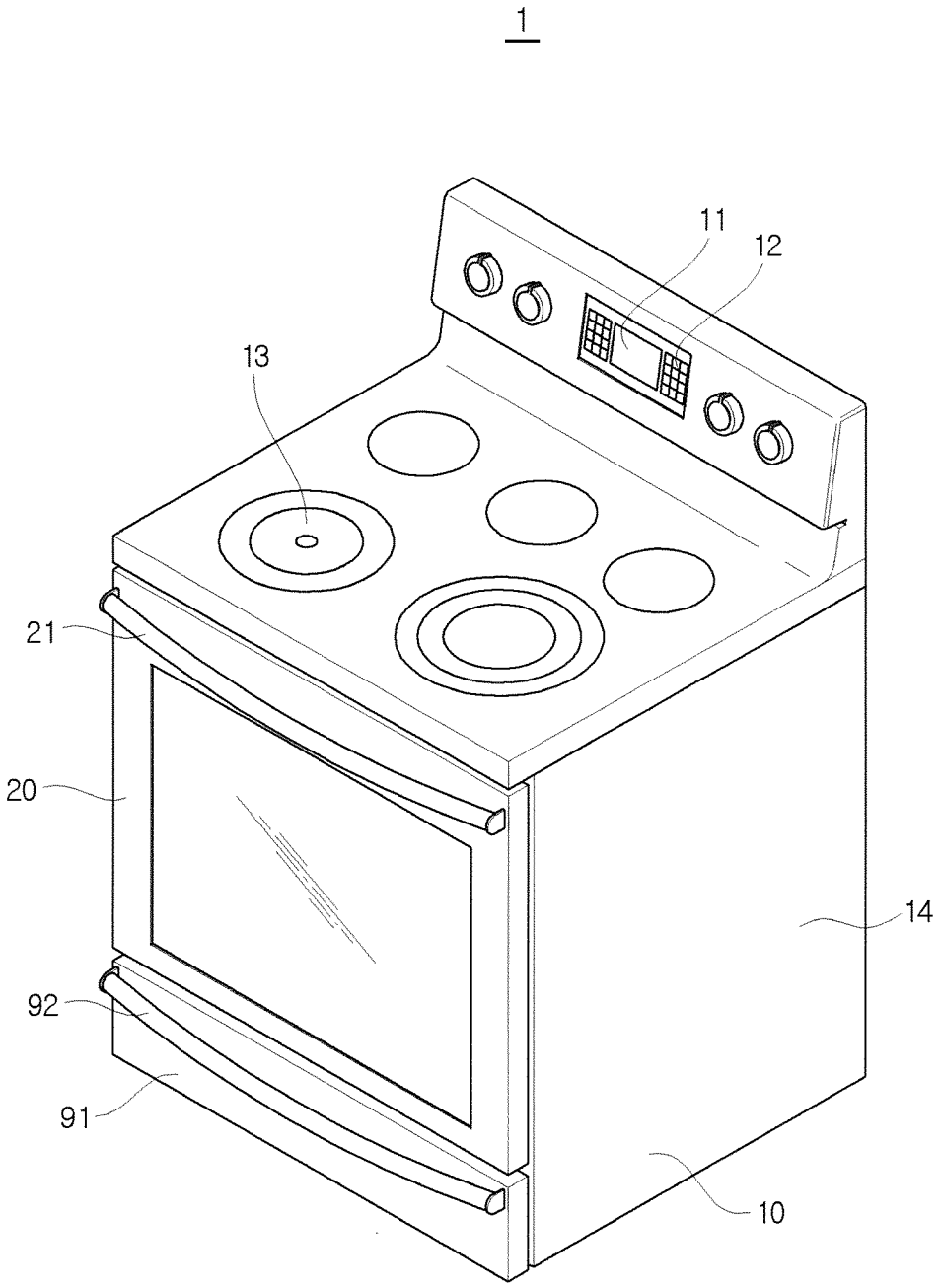
FIG. 1 illustrates a gas oven in accordance with various embodiments of the present disclosure.
Figure 2:
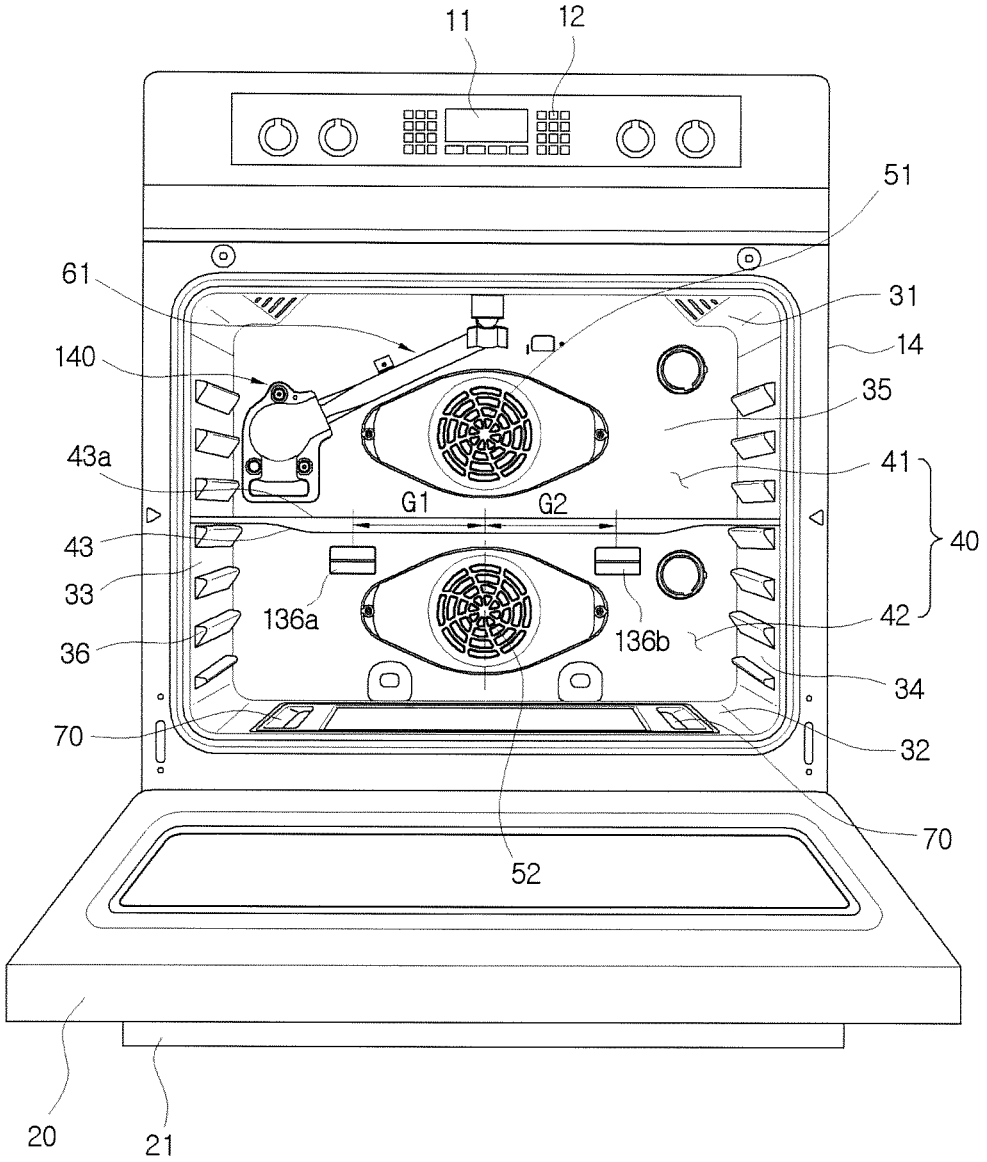
FIG. 2 illustrates an inside of the gas oven in accordance with various embodiments of the present disclosure.

FIG. 1 is a perspective view of a gas oven in accordance with a first embodiment of the present disclosure. FIG. 2 is a perspective view illustrating an inside of the gas oven in accordance with the first embodiment of the present disclosure.

Referring to FIGS. 1 and 2, a gas oven 1 includes a cooking space 40 that is provided inside a body 10 and accommodates ingredients, a plurality of burners 61 that generates heat by burning gas, and a plurality of convection fans 51 and 52 that convect air in the cooking space 40.

The cooking space 40 is formed in an approximate box shape that includes a top wall 31, a bottom wall 32, a left sidewall 33, and a right sidewall 34, and a rear wall 35 as inner walls thereof, and an open front to withdraw and insert ingredients. The open front may be opened and closed by a door 20 hinge-coupled with the body 10 to be pivotable up and down. The door 20 may include a handle 21.

On a top end of the body 10, a cooktop portion 13 on which a container in which ingredients are contained is disposed to be heated, a display portion 11 that displays various pieces of operation information of the gas oven 1, and an operation portion 12 for operating an operation of the gas oven 1.

Meanwhile, a plurality of supporters 36 on which a rack (not shown) to put ingredients thereon is mountable are provided inside the cooking space 40. The plurality of supporters 36 may be provided to protrude from the left sidewall 33 and the right sidewall 34.

A divider 43 capable of dividing the cooking space 40 may be separably mounted on the plurality of supporters 36. The divider 43 may be horizontally mounted in the cooking space 40 to divide the cooking space 40 into an upper separate cooking space 41 and a lower separate cooking space 42.

Hereinafter, the upper separate cooking space 41 will be referred to as a first separate cooking space 41, and the lower separate cooking space 42 will be referred to as a second separate cooking space 42. Respective sizes of the first separate cooking space 41 and the second separate cooking space 42 are not necessarily identical to each other and may be different from each other. The divider 43 may have an insulating material, and may insulate the first separate cooking space 41 and the second separate cooking space 42 from each other.

One of the plurality of burners 61 is provided in the first separate cooking space 41, and another burner (not shown) of the plurality of burners 61 is provided in the second separate cooking space 42. Hereinafter, the burner 61 provided in the first separate cooking space 41 will be referred to as a first burner 61 and the burner provided in the second separate cooking space 42 will be referred to as a second burner (not shown). Accordingly, the first burner 61 may emit heat to the first separate cooking space 41 and the second burner may emit heat to the second separate cooking space 42. The second burner is disposed below a second air supply flow channel 70, that is, below the bottom wall 32 to discharge heated air through the second air supply flow channel 70.

Also, one convection fan 51 of the plurality of convection fans 51 and 52 is provided in the first separate cooking space 41 and the other convection fan 52 of the plurality of convection fans 51 and 52 is provided in the second separate cooking space 42. Accordingly, the convection fan 51 may convect air in the first separate cooking space 41 and the convection fan 52 may convect air in the second separate cooking space 42.

A storage compartment 90 capable of storing cooking containers may be provided below the cooking space 40. The storage compartment 90 may be opened and closed by a drawer 91 slidably inserted and withdrawn. The drawer 91 may include a handle 92.

Meanwhile, the gas oven 1 may include the second air supply flow channel 70 that connects the second separate cooking space 42 with an outside of the body 10 to supply air to the second separate cooking space 42. As is well known, gas, air, and flames are necessary for combustion, and the air for combustion may be supplied to the second separate cooking space 42 through the second air supply flow channel 70.

The second air supply flow channel 70 may supply air to the second separate cooking space 42 when the divider 43 is mounted in the cooking space 40 and may supply air to the entire cooking space 40 when the divider 43 is removed from the cooking space 40.

Also, the gas oven 1 may include a main air discharge flow channel (not shown) that connects the first separate cooking space 41 with the outside of the body 10 to discharge waste gas of the first separate cooking space 41. Here, the waste gas means combustion gas that occurs after combustion. When gas is completely burned, carbon monoxide, steam, etc. may occur. When gas is incompletely burned, carbon monoxide, hydrogen, sulfur, etc. may occur. When the waste gas is not discharged and remains, since incomplete combustion occurs at a burner, it is necessary to discharge the waste gas outward.

The main air discharge flow channel may be formed of an air discharge hole that passes through the top wall 31 and an air discharge duct that connects the air discharge hole with the outside of the body 10.

The main air discharge flow channel may discharge the waste gas in the first separate cooking space 41 when the divider 43 is mounted in the cooking space 40, and may discharge the waste gas in the entire cooking space 40 when the divider 43 is removed from the cooking space 40.

Also, the gas oven 1 includes an air supply device 100 that may naturally or forcibly supply air to the first separate cooking space 41. Basically, the air supply device 100 is intended to supply air to the first separate cooking space 41 when the divider 43 is mounted in the cooking space 40.

This is because air supplied to the second separate cooking space 42 through the second air supply flow channel 70 is prevented from flowing to the first separate cooking space 41 when the divider 43 is mounted in the cooking space 40.

In addition, the air supply device 100 supplies air to the first separate cooking space 41 when the first burner 61 and the second burner are operated together. Particularly, in this case, the air supply device 100 forcibly supplies air to the first separate cooking space 41. In this aspect, the air supply device 100 may be referred to as a forced air supply device. Detailed components and functions of the air supply device 100 will be additionally described below.

Also, the gas oven 1 includes an auxiliary air discharge device that may discharge waste gas in the second separate cooking space 42. The auxiliary air discharge device is intended to discharge the waste gas in the second separate cooking space 42 when the divider 43 is mounted in the cooking space 40.

This is because the waste gas in the second separate cooking space 42 cannot be discharged through the main air discharge flow channel when the divider 43 is mounted in the cooking space 40. The auxiliary air discharge device will be additionally described below.

Figure 6:
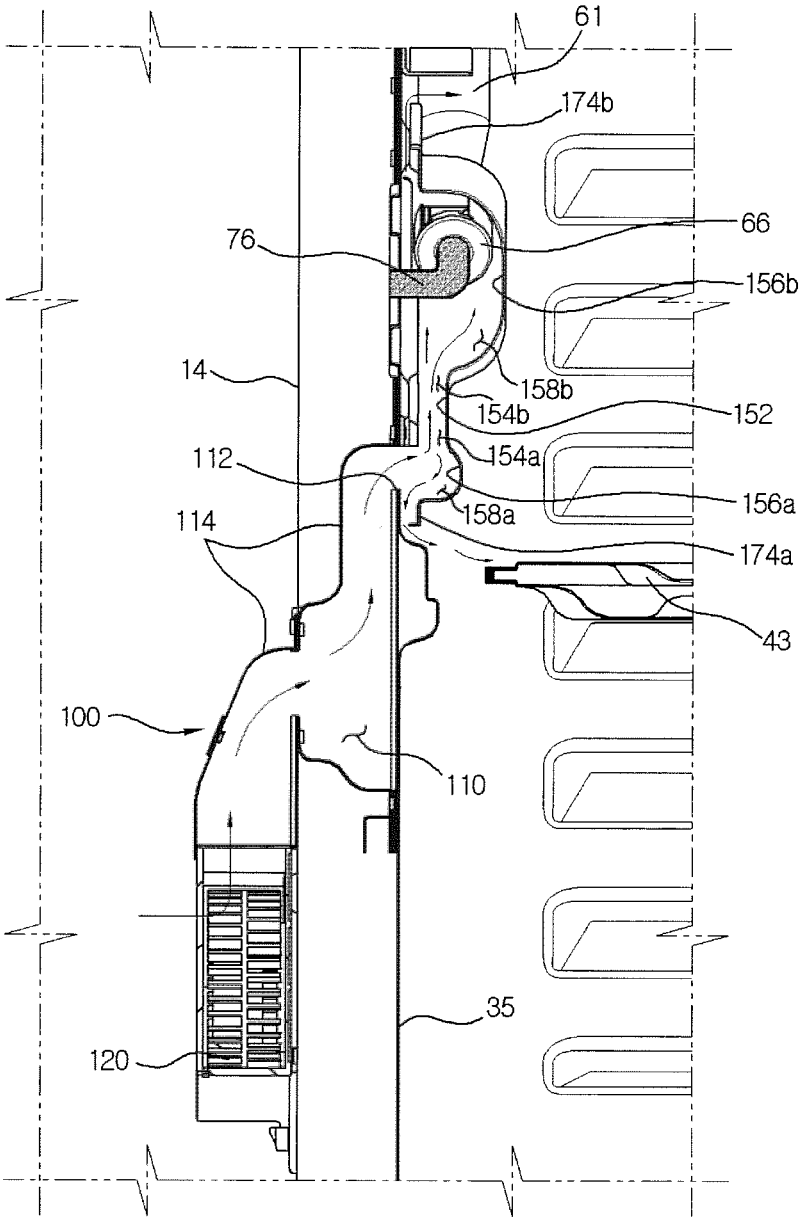
FIG. 6 illustrates an air supply device that illustrates an air flow therein in accordance with various embodiments of the present disclosure.

Referring to FIG. 6, the air supply device 100 may include an air supply duct 114, a first air supply flow channel 110 that connects the first separate cooking space 41 with the outside of the body 10 in the air supply duct 114, and an air supply fan 120 that forces air outside the cooking space 40 to be moved to the first separate cooking space 41 through the first air supply flow channel 110.

The first air supply flow channel 110 may pass through both the rear wall 35 of the cooking space 40 and an external case 14 of the body 10. The first air supply flow channel 110 may be formed inside the air supply duct 114. A part of the air supply duct 114 may be disposed in the first separate cooking space 41. Gas and air may flow into an internal space 63 of the first burner 61 through a head portion 66 of the first burner 61. Gas may be guided to an inside of the head portion 66 through a gas supply flow channel, and may be jetted into the internal space 63 of the first burner 61 through a nozzle 76 provided at an end of the gas supply flow channel. The gas supply flow channel may be fixed to the rear wall 35 using a holder.

When gas is jetted to the internal space 63 of the first burner 61 through the nozzle 76, part of air in the air supply duct 114 may be suctioned together with gas into the internal space 63 of the first burner 61 through an inlet hole 64 formed in the head portion 66.

The gas and air that flow into the internal space 63 of the first burner 61 may be mixed in the internal space 63 of the first burner 61 and may be ejected through an ejection hole 65 (refer to FIG. 2) of the first burner 61. The mixed gas may be burned by flames ignited at an igniter (not shown). Here, the air that flows together with the gas into the first burner 61 as described above may be referred to as a primary air.

Air to be supplied to the first separate cooking space 41 through a supply guide portion 170 of a distribution unit 140 that will be described below may flow around the ejection hole 65 of the first burner 61 and be mixed with the gas ejected from the ejection hole 65 to be burned. Here, the air that does not flow into the first burner 61 and flows around the ejection hole 65 of the first burner 61 through the supply guide portion 170 may be referred to as a secondary air.

Accordingly, the first burner 61 receives the primary air and secondary air to produce combustion.

Meanwhile, the air supply fan 120 forcibly suctions air outside the cooking space 40 and allows the air to flow into the first burner 61 or around the first burner 61. As described above, the reason that the air supply fan 120 forces the air to flow is to allow the first burner 61 and the second burner to operate at the same time.

This is because waste gas, which occurs at the second burner when the first burner 61 and the second burner operate at the same time, rises and flows around the first burner 61 and then incomplete combustion occurs at the first burner 61 due to the waste gas that flows around the first burner 61 as described above. In another aspect, due to the waste gas of the second burner, it is difficult to supply the secondary air to the first burner 61.

Accordingly, to allow the first burner 61 and the second burner to operate at the same time an amount of air ejected through an overflow portion 174 among the air forcibly supplied by the air supply fan 120 must be enough to push the waste gas of the second burner to the main air discharge flow channel.

Meanwhile, air must be forcibly supplied using the air supply fan 120 not only when the divider 43 is removed from the cooking space 40, but also when the divider 43 is mounted in the cooking space 40. Since the waste gas of the second burner may flow in around the first burner 61 through a gap between the divider 43 and the door 20, a gap between the divider 43 and both of the left and right sidewalls 33 and 34 (refer to FIG. 2), and a gap between the divider 43 and the rear wall 35 even when the divider 43 is mounted in the cooking space 40.

Figure 3:
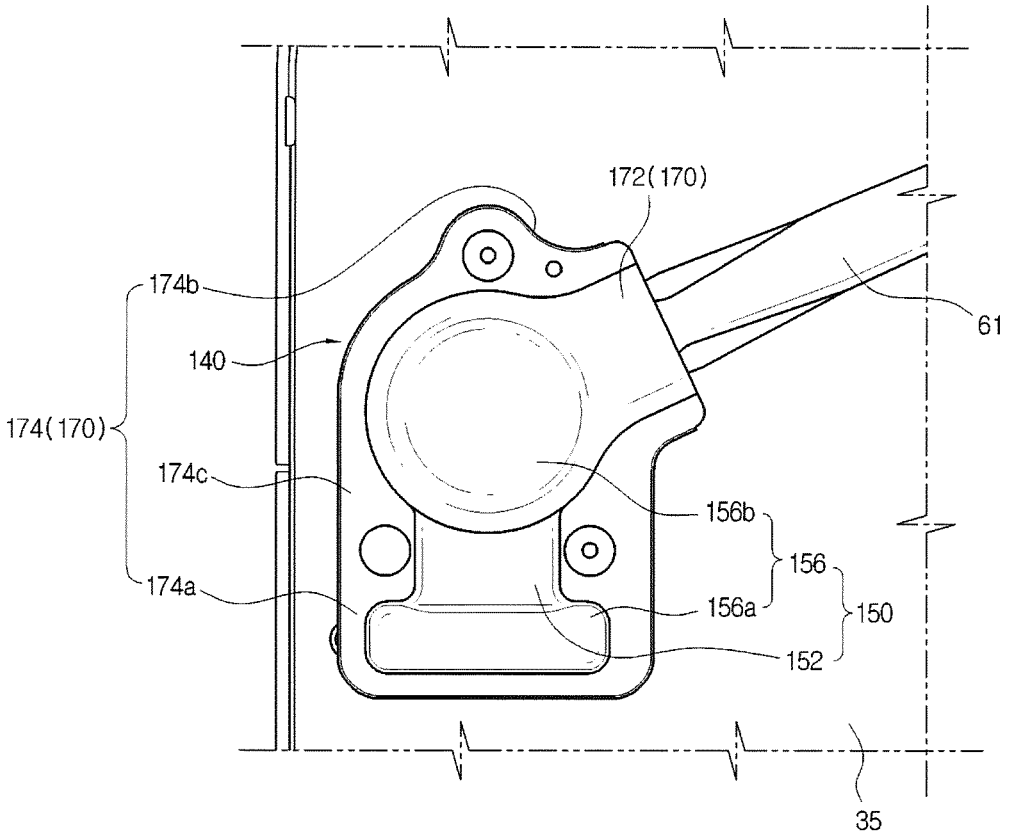
FIG. 3 illustrates a distribution unit in accordance with various embodiments of the present disclosure.
Figure 4:
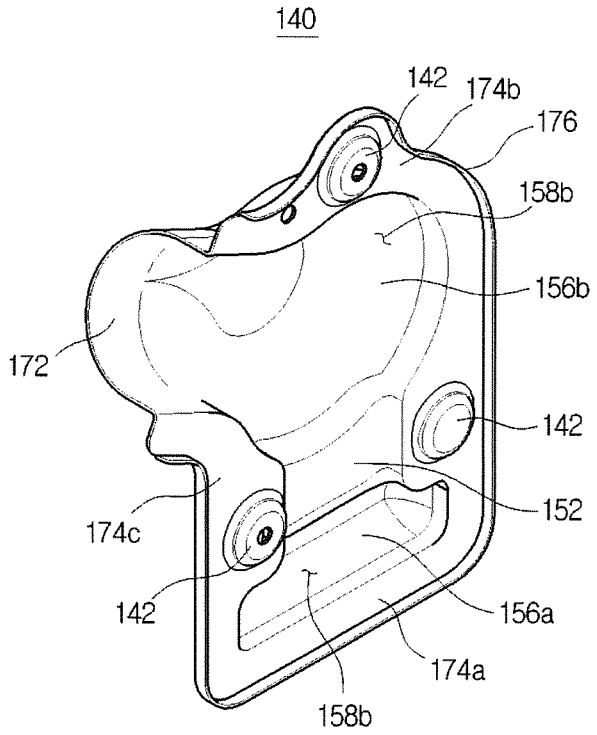
FIG. 4 illustrates the distribution unit in accordance with various embodiments of the present disclosure.
Figure 5:
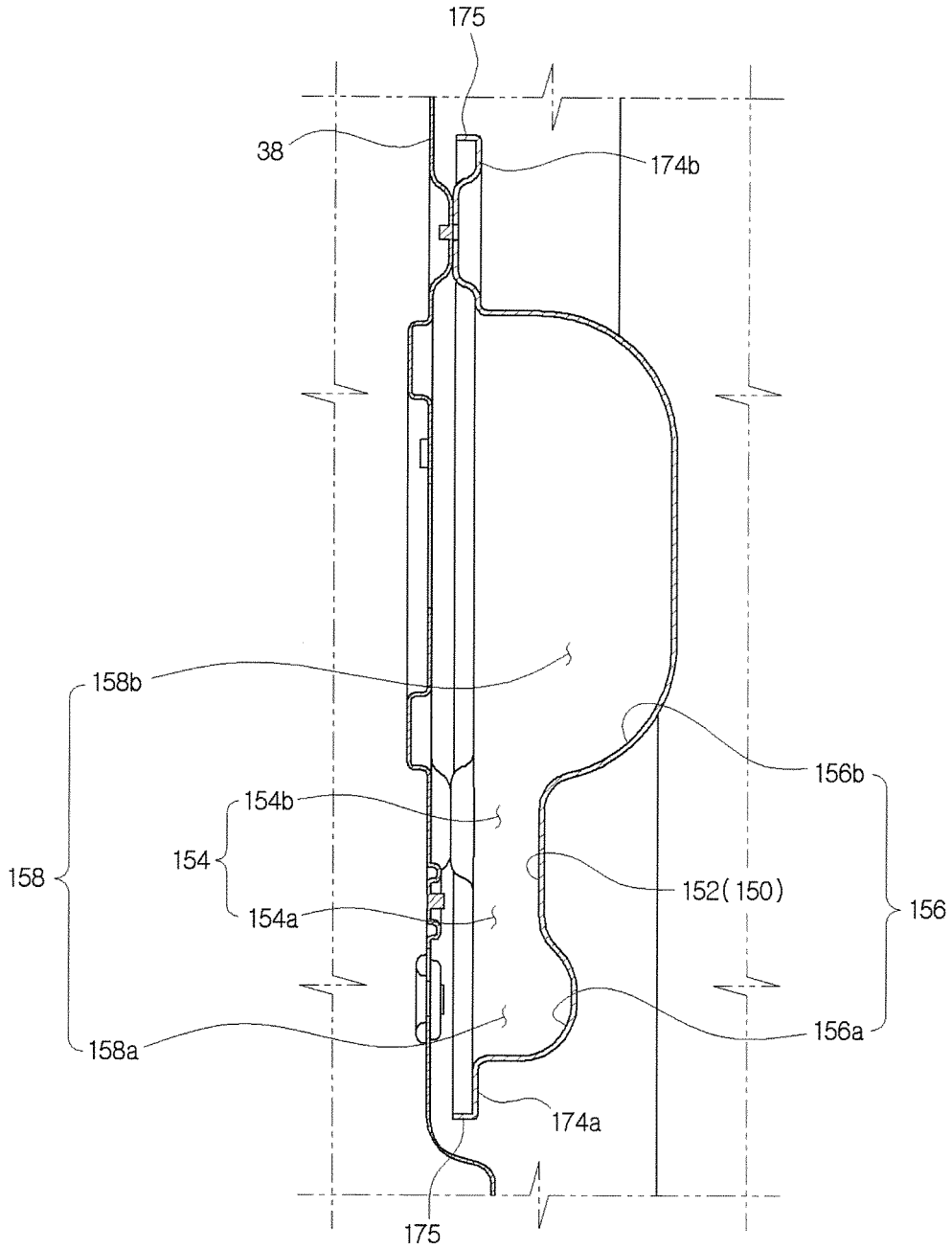
FIG. 5 illustrates a coupled state of the distribution unit in accordance with various embodiments of the present disclosure.
Figure 7:
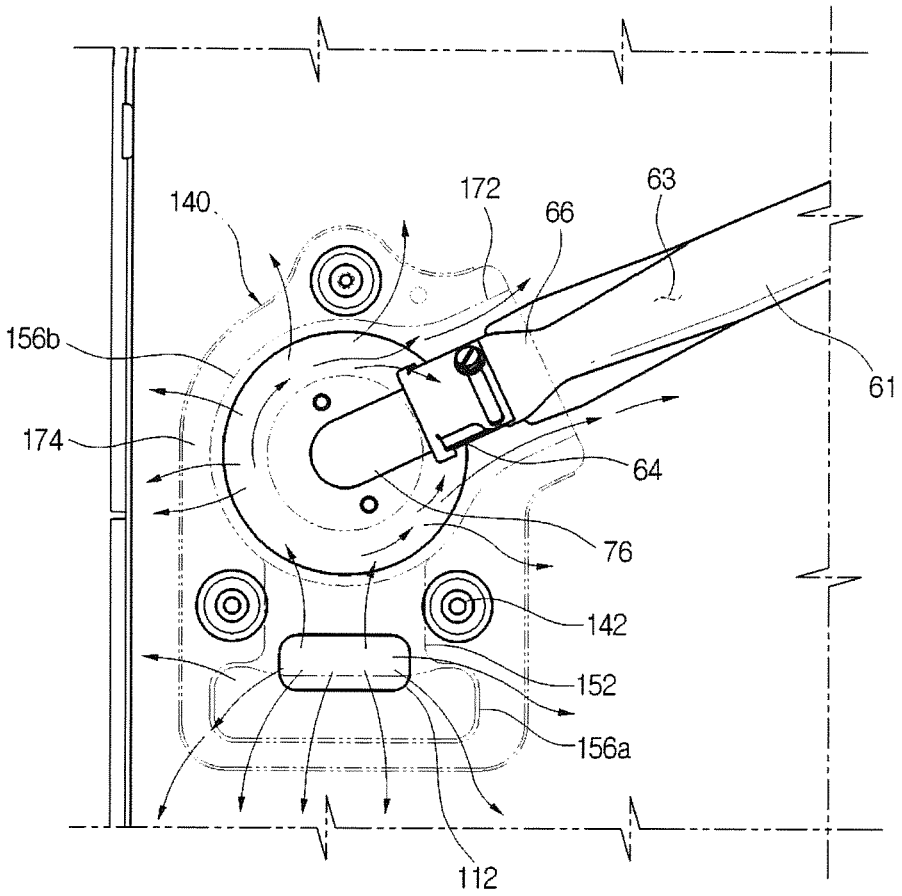
FIG. 7 illustrates an air flow in the distribution unit accordance with various embodiments of the present disclosure.

FIG. 3 is an enlarged view of the distribution unit 140 in accordance with the first embodiment of the present disclosure. FIG. 4 is a perspective view of the distribution unit 140 in accordance with the first embodiment of the present disclosure. FIG. 5 is a perspective view illustrating a coupled state of the distribution unit 140 in accordance with the first embodiment of the present disclosure. FIG. 6 is a cross-sectional view of the air supply device 100 in accordance with the first embodiment of the present disclosure, which illustrates an air flow therein. FIG. 7 is a view illustrating an air flow in the distribution unit 140 accordance with the first embodiment of the present disclosure.

The distribution unit 140 is provided in an ejection portion 112 of the air supply flow channels 70 and 110 to distribute air supplied through the air supply flow channels 70 and 110. In detail, the distribution unit 140 is disposed in an ejection direction of the ejection portion 112 of the first air supply flow channel 110 to distribute outside air supplied through the first air supply flow channel 110 as the primary air and the secondary air. Also, the secondary air may be allowed to be efficiently supplied to the first separate cooking space 41 through the distribution unit 140.

The distribution unit 140 may be provided so as to not expose the ejection portion 112 of the air supply flow channels 70 and 110 to the cooking space 40.

That is, the distribution unit 140 may be disposed in the ejection direction of the ejection portion 112 and may be provided so as to not directly expose the ejection portion 112 to the cooking space 40. In detail, the distribution unit 140 is disposed in the ejection direction of the ejection portion 112 to cut off the air ejected from the ejection portion 112. Since the distribution unit 140 is disposed in the (air) ejection direction of the ejection portion 112, heated air formed in the cooking space 40 may be prevented from flowing back toward the ejection portion 112. In the embodiment, since the ejection portion 112 is provided in the rear wall 35, the distribution unit 140 may be disposed in front of the ejection portion 112.

Since the ejection portion 112 of the first air supply flow channel 110 for supplying outside air to the first separate cooking space 41 is disposed on the rear wall 35, the distribution unit 140 is disposed on the rear wall 35 in the embodiment. However, the distribution unit 140 is not limited thereto, and may be disposed in any one of the top wall 31, the bottom wall 32, the left sidewall 33, the right sidewall 34, and the rear wall 35 that form the inner walls of the cooking space 40 depending on a disposition of the first air supply flow channel 110.

The distribution unit 140 may be coupled with the rear wall 35 by a unit coupling portion 142. The unit coupling portion 142 may be provided above the overflow portion 174, which will be described below, and may protrude further than the overflow portion 174 to allow the overflow portion 174 to form an overflow gap 175 between the overflow portion 174 and the rear wall 35.

The distribution unit 140 may include a distribution guide portion 150 and the supply guide portion 170. The air supplied through the first air supply flow channel 110 is passed through the distribution guide portion 150 and may be discharged outside the distribution unit 140 through the supply guide portion 170. That is, the air supplied through the first air supply flow channel 110 may supply the primary air to a burner through the supply guide portion 170, or may supply the secondary air to the first separate cooking space 41. The supply guide portion 170 includes a supply portion 172 and the overflow portion 174. The supply guide portion 170 will be described below.

The distribution guide portion 150 is provided to distribute or guide the air supplied through the air supply flow channels 70 and 110. The distribution guide portion 150 may form a distribution flow channel 154 and a guide flow channel 158, which will be described below, due to an inner surface thereof. To reduce air resistance of air that flows through flow channels, the inner surface of the distribution guide portion 150 may be curved.

The distribution guide portion 150 may include a distribution portion 152 and a guide portion 156.

The distribution portion 152 may distribute the air supplied through the first air supply flow channel 110. The distribution portion 152 may be formed so as to be closer to the ejection portion 112 of the first air supply flow channel 110 than the adjacent inner surface of the distribution unit 140. In detail, in the embodiment, since the ejection portion 112 of the first air supply flow channel 110 is provided in the rear wall 35 of the cooking space 40, the distribution portion 152 may be formed closer to the ejection portion 112 of the first air supply flow channel 110 formed in the rear wall 35 than the adjacent inner surface of the distribution unit 140. In the embodiment, the distribution portion 152 may protrude further toward the rear wall 35 from the inner surface of the distribution unit 140 than an inner surface of the guide portion 156.

The distribution portion 152 may form the distribution flow channel 154 that distributes the air supplied through the ejection portion 112 of the first air supply flow channel 110. The distribution flow channel 154 may include a first distribution flow channel 154*a* that faces downwards and a second distribution flow channel 154*b* that faces upwards. The first distribution flow channel 154*a* may be provided to be guided by a first guide portion 156*a*, which will be described below, to be discharged toward a bottom of the cooking space 40. The second distribution flow channel 154*b* may be provided to be guided by a second guide portion 156*b*, which will be described below, to be discharged toward the middle and top of the cooking space 40.

The guide portion 156 is provided adjacent to the distribution portion 152 to guide the air distributed from the distribution portion 152. The guide portion 156 is provided to be connected with the distribution portion 152. The guide flow channel 158 connected with the distribution flow channel 154 is formed in the guide portion 156.

The guide portion 156 may include the first guide portion 156*a* and the second guide portion 156*b*.

The first guide portion 156*a* is disposed on one side of the distribution portion 152 and may be disposed closer to a bottom surface of the cooking space 40 than the distribution portion 152. The first guide portion 156*a* focus a first guide flow channel 158*a* in a longitudinal direction parallel to the bottom surface of the cooking space 40. The first guide flow channel 158*a* is provided to be connected with the first distribution flow channel 154*a* described above.

That is, air that flows through the first distribution flow channel 154*a* among the air distributed by the distribution portion 152 is guided to the first guide flow channel 158*a*.

The first guide flow channel 158*a* is formed in the longitudinal direction parallel to the bottom surface of the cooking space 40 to allow the secondary air to be discharged to the bottom surface of the cooking space 40. In detail, the air supplied through the first guide flow channel 158*a* may be discharged to the bottom surface of the cooking space 40 due to a first overflow portion 174*a* that will be described below. Since the distribution unit 140 is disposed in the first separate cooking space 41 in the embodiment, the air supplied through the first guide flow channel 158*a* and the first overflow portion 174*a* may be supplied to a top surface 43*a* of the divider 43, which forms a bottom surface of the first separate cooking space 41. Since, as will be described, the first overflow portion 174*a* is formed along a circumference of the first guide portion 156*a*, the air guided through the first guide flow channel 158*a* of the first guide portion 156*a* may be discharged not only to the bottom surface of the cooking space 40, but also to both sides of the cooking space 40.

Since the first guide flow channel 158*a* is formed to elongate in a longitudinal direction parallel to the top surface 43*a* of the divider 43 compared with the first distribution flow channel 154*a*, it is possible to supply the secondary air to a larger area of the top surface 43*a* of the divider 43 through the first guide flow channel 158*a*.

The second guide portion 156*b* is disposed on the other side of the distribution portion 152. The second guide portion 156*b* fauns a second guide flow channel 158*b*. The second guide flow channel 158*b* is provided to be connected with the second distribution flow channel 154*b* described above.

That is, air that flows through the second distribution flow channel 154*b* among the air distributed by the distribution portion 152 may be guided to the second guide flow channel 158*b*.

The second guide portion 156*b* is disposed above the distribution portion 152 to guide part of the air distributed by the distribution portion 152 to the supply portion 172 and a second overflow portion 174*b* that will be described below.

A shape of the second guide portion 156*b* is not limited, but may be formed as a hemispherical shape in the embodiment. In detail, the air supplied through the second guide flow channel 158*b* may be discharged to the top and sides of the cooking space 40 due to the second overflow portion 174*b* that will be described below. Since the distribution unit 140 is disposed in the first separate cooking space 41 in the embodiment, the air supplied through the second guide flow channel 158*b* and the second overflow portion 174*b* may be supplied to the top wall 31, the left sidewall 33, and the right sidewall 34 of the first separate cooking space 41. As will be described below, since the second overflow portion 174*b* is faulted along a circumference of the second guide portion 156*b*, the air guided through the second guide flow channel 158*b* of the second guide portion 156*b* may be discharged not only to the top and both sides of the cooking space 40, but also to the bottom of the cooking space 40.

The first guide portion 156*a* is configured to be parallel to the top surface 43*a* of the divider 43 in the embodiment, but is not limited thereto. Also, the guide portion 156 has been described as including a pair of such guide portions 156 for convenience of description, but is not limited thereto. The guide portion 156 may be satisfied with any component configured to correspond to a shape of the cooking space 40 in which the air supplied by the distribution portion 152 to be supplied to the inside of the cooking space 40 by a plurality of such guide portions 156.

The supply guide portion 170 includes the supply portion 172 and the overflow portion 174. The supply guide portion 170 is provided to supply the air that passes through the distribution guide portion 150 to the cooking space 40 or the burner. The supply guide portion 170 may be formed along the whole circumference of the distribution guide portion 150 on an inner wall. Since the distribution unit 140 and the ejection portion 112 are disposed at the rear wall 35, the supply guide portion 170 may be formed on the rear wall 35 along the whole circumference of the distribution guide portion 150. Since the air guided by the distribution guide portion 150 is discharged through the supply guide portion 170 formed on the whole reference of the distribution guide portion 150, the air heated in the cooking space 40 may be prevented from flowing back into the distribution guide portion 150 through the supply guide portion 170.

The supply guide portion 170 is provided to be formed along the whole area of the circumference of the distribution guide portion 150 in the embodiment, but may be formed on a part thereof.

The supply portion 172 is provided on one side of the distribution guide portion 150 so as to eject air that is mixed with gas that flows into the burner. The supply portion 172 may be provided to be connected with the guide portion 156. In the embodiment, the supply portion 172 is provided to extend from the second guide portion 156*b* and to connect with the second guide portion 156*b*.

The supply portion 172 may be provided to be spaced apart at certain intervals along a circumference of the head portion 66 of the burner 61. Through the components described above, the air that moves to the supply portion 172 among the air guided to the second guide portion 156*b* may be supplied to the head portion 66 of the burner 61 as the primary air or to not flow into the head portion 66 of the burner 61, but to be supplied to the inside of the cooking space 40 as the secondary air.

The overflow portion 174 is provided to eject air to the cooking space 40. In detail, the overflow portion 174 is provided to allow the air guided by the guide portion 156 to be supplied to the cooking space 40. The overflow portion 174 is formed along at least a part of the circumference of the distribution guide portion 150 to eject the air to the cooking space 40. The overflow portion 174 may be formed as a shape of a surface that faces the rear wall 35 along the at least a part of the circumference of the distribution guide portion 150 with certain widths. To uniformly supply the secondary air from the distribution unit 140 to the cooking space 40 in various directions, the overflow portion 174 may be formed with the certain widths. However, it is not limited thereto, the width of the overflow portion 174 may be different in some sections as necessary.

The overflow portion 174 may be formed to be spaced at a certain interval from the inner wall of the cooking space 40. In detail, since the distribution unit 140 is disposed on the rear wall 35 of the cooking space 40, the overflow portion 174 may be formed to be spaced at a certain interval from the rear wall 35. The interval between the overflow portion 174 and the rear wall 35 is provided to be smaller than an interval between the guide portion 156 and the rear wall 35.

The overflow portion 174 may include the overflow gap 175. The overflow gap 175 is provided between the overflow portion 174 and the rear wall 35 to allow the air guided by the guide portion 156 to flow.

The overflow portion 174 may further include an overflow rib 176. The overflow rib 176 is formed along an outer edge of the overflow portion 174 and is provided to be bent from the outer edge toward the inner wall. The overflow gap 175 may include a first overflow gap 175 formed between the overflow portion 174, and the rear wall 35 and a second overflow gap 175 formed between the overflow rib 176 and the rear wall 35.

Since an end of the overflow rib 176 is provided closer to the rear wall 35 than the overflow portion 174, the second overflow gap 175 is formed to be smaller than the first overflow gap 175.

Through the components described above, the air in the cooking space 40 may be prevented from flowing back toward the guide portion 156 through the overflow portion 174 while the air guided through the guide portion 156 is discharged to the cooking space 40 through the overflow portion 174.

The air that flows back from the first separate cooking space 41 to an inside of the distribution unit 140 may be cut off by a pressure of the air discharged from the inside of the distribution unit 140 and the overflow rib 176.

The overflow portion 174 may include the first overflow portion 174*a* formed along at least part of the circumference of the first guide portion 156*a*, and the second overflow portion 174*b* formed along at least part of the circumference of the second guide portion 156*b*. Also, the overflow portion 174 may further include a third overflow portion 174*c* formed along at least part of a circumference of the distribution portion 152.

Figure 8:
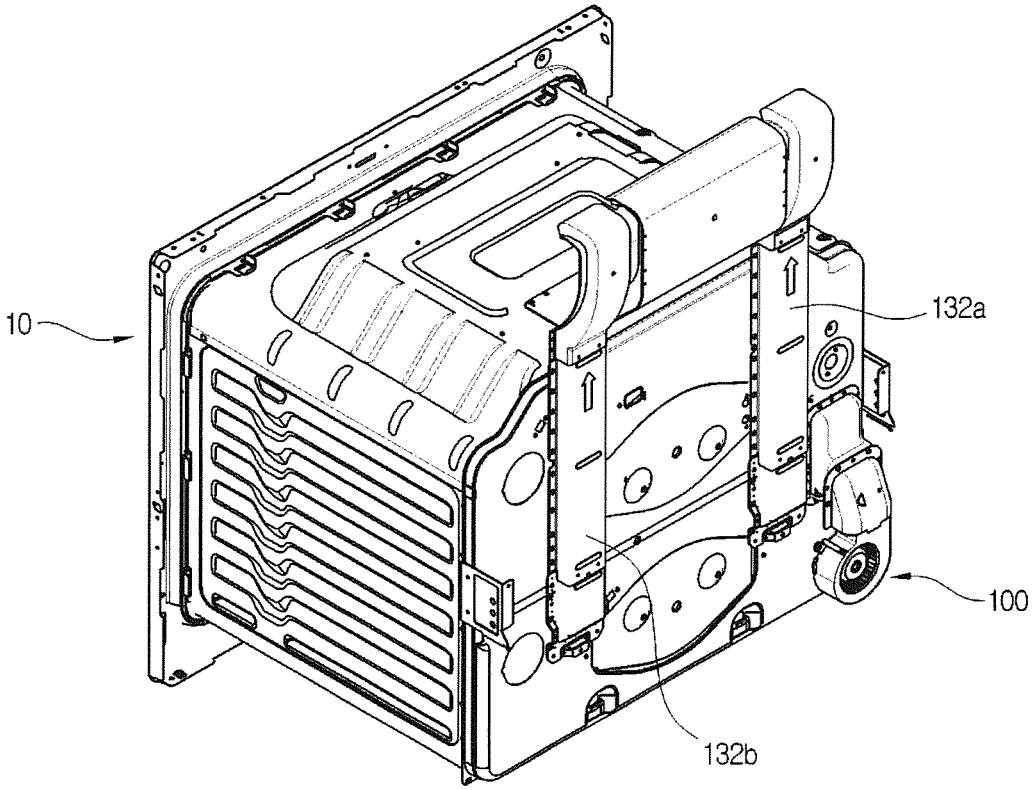
FIG. 8 illustrates a body from which an external case is removed in accordance with various embodiments of the present disclosure.

FIG. 8 is a rear perspective view of the body 10 in accordance with the first embodiment of the present disclosure, from which the external case is removed.

Referring to FIGS. 2 and 8, an auxiliary air discharge device 130 may include auxiliary air discharge ducts 132*a* and 132*b* that connect the second separate cooking space 42 with the outside, and an auxiliary air discharge flow channel 134 formed in the auxiliary air discharge ducts 132*a* and 132*b*. Auxiliary discharge portions 136*a* and 136*b* connected to the auxiliary air discharge ducts 132*a* and 132*b* are provided on the rear wall 35.

The auxiliary discharge portions 136*a* and 136*b* may be provided as a first auxiliary discharge portion 136*a* spaced at a first interval G1 from a center of the second separate cooking space 42 in a lateral direction on a left side thereof, and a second auxiliary discharge portion 136*b* spaced at a second interval G2 from the center on a right side thereof.

The first auxiliary discharge portion 136*a* and the second auxiliary discharge portion 136*b* may be formed to have the same area, and the first interval G1 and the second interval G2 may be identically provided. Through the components described above, control temperature distribution may be uniform in the second separate cooking space 42. Also, instead of applying a single auxiliary discharge portion having a large area, a plurality of such auxiliary discharge portions 136*a* and 136*b* with a total area smaller than that of the single auxiliary discharge portion are provided, thereby reducing a loss in heat discharged together with waste gas through the auxiliary discharge portions 136*a* and 136*b* form the inside of the second separate cooking space 42.

Also, when the gas oven 1 performs self-cleaning at a high temperature, the waste gas is discharged through the auxiliary discharge portions 136*a* and 136*b*. The plurality of auxiliary discharge portions 136*a* and 136*b* with the total area smaller than that of the single auxiliary discharge portion with the large area are provided, thereby reducing the loss in heat and improving cleaning efficiency.

The auxiliary air discharge ducts 132*a* and 132*b* include a first auxiliary air discharge duct 132*a* connected with the first auxiliary discharge portion 136*a* and a second auxiliary air discharge duct 132*b* connected with the second auxiliary discharge portion 136*b*.

A pair of such auxiliary discharge portions 136*a* and 136*b* are provided to be disposed spaced at the same interval from the center of the second separate cooking space 42 in the lateral direction in the embodiment, but the arrangement and number of the auxiliary discharge portions 136*a* and 136*b* are not limited thereto.

For example, a plurality of auxiliary discharge portions that are spaced at identical intervals may be provided. The plurality of auxiliary discharge portions may be disposed at the identical intervals, may be arranged while converging on the center of the second separate cooking space 42 in the lateral direction, or may be arranged while converging on the left and right sides of the second separate cooking space 42.

Hereinafter, a gas oven in accordance with a second embodiment of the present disclosure will be described.

Repetitive descriptions of components identical to those in the previous embodiment will be omitted.

Figure 9:
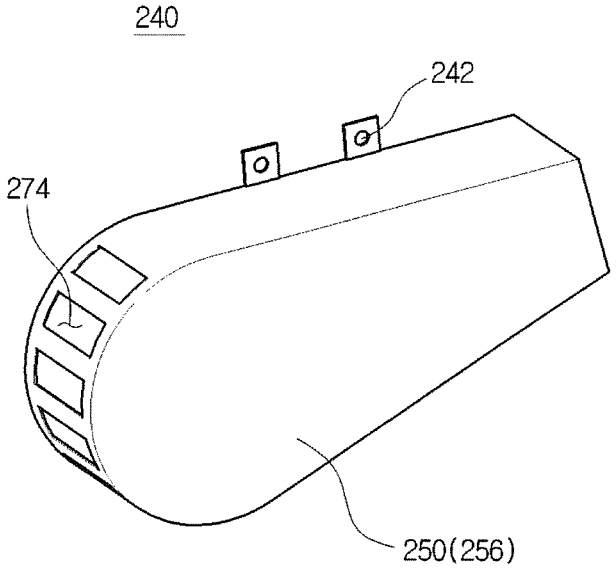
FIGS. 9 and 10 illustrate a distribution unit in accordance with various embodiments of the present disclosure.
Figure 10:
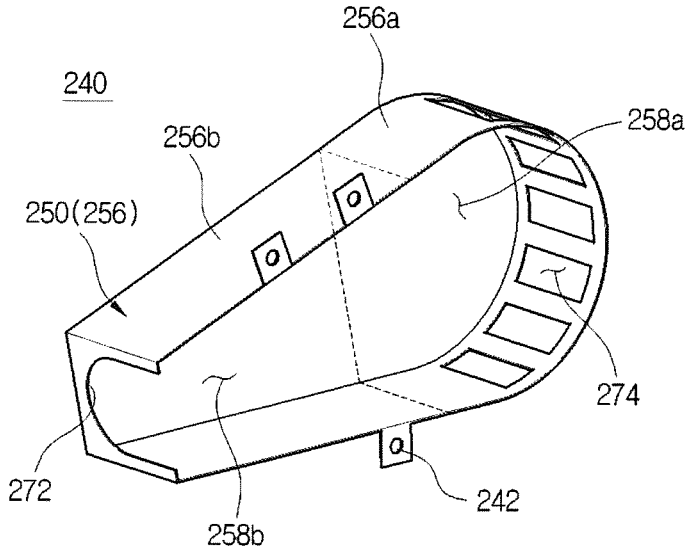
Figure 11:
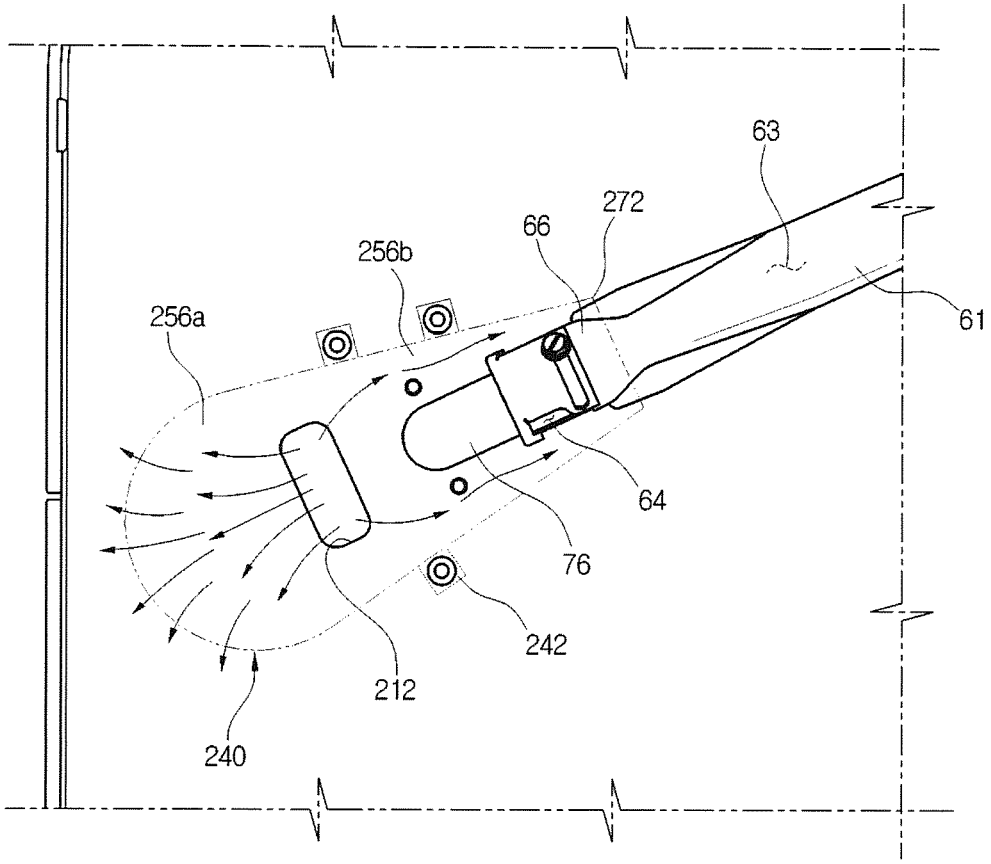
FIG. 11 illustrates an air flow in the distribution unit accordance with various embodiments of the present disclosure.

FIGS. 9 and 10 are perspective views of a distribution unit in accordance with the second embodiment of the present disclosure. FIG. 11 is a view illustrating an air flow in the distribution unit accordance with the second embodiment of the present disclosure.

A distribution unit 240 is provided in an ejection portion 212 of the air supply flow channels 70 and 110 to distribute air supplied through the air supply flow channels 70 and 110. In detail, the distribution unit 240 is disposed in an ejection direction of the ejection portion 112 of the first air supply flow channel 110 to distribute outside air supplied through the first air supply flow channel 110 as the primary air and the secondary air. Also, the secondary air may be efficiently supplied to the first separate cooking space 41 through the distribution unit 240.

The distribution unit 240 may be provided so as to not expose the ejection portion 212 of the air supply flow channels 70 and 110 to the cooking space 40.

That is, the distribution unit 240 may be disposed in the ejection direction of the ejection portion 212 and may be provided so as to not directly expose the ejection portion 212 to the cooking space 40. In detail, the distribution unit 240 is disposed in the ejection direction of the ejection portion 212 to cut off the air ejected from the ejection portion 212. Since the distribution unit 240 is disposed in the (air) ejection direction of the ejection portion 212, heated air formed in the cooking space 40 may be prevented from flowing back toward the ejection portion 212. In the embodiment, since the ejection portion 212 is provided in the rear wall 35, the distribution unit 240 may be disposed in front of the ejection portion 212.

Since the ejection portion 212 of a first air supply flow channel 210 for supplying outside air to the first separate cooking space 41 is disposed on the rear wall 35, the distribution unit 240 is disposed on the rear wall 35 in the embodiment. However, the distribution unit 240 is not limited thereto, and may be disposed in any one of the top wall 31, the bottom wall 32, the left sidewall 33, the right sidewall 34, and the rear wall 35 that form the inner walls of the cooking space 40 depending on a disposition of the first air supply flow channel 210.

The distribution unit 240 may be coupled with the rear wall 35 by a unit coupling portion 242.

The distribution unit 240 may include a distribution guide portion 250 and a supply guide portion 270. The air supplied through the first air supply flow channel 210 is passed through the distribution guide portion 250 and may be discharged outside the distribution unit 240 through the supply guide portion 270. That is, the air supplied through the first air supply flow channel 210 may supply the primary air to a burner through the supply guide portion 270, or may supply the secondary air to the first separate cooking space 41. The supply guide portion 270 includes a supply portion 272 and an overflow portion 274. The supply guide portion 270 will be described below.

The distribution guide portion 250 is provided to distribute or guide the air supplied through the air supply flow channels 70 and 110. The distribution guide portion 250 may form a distribution flow channel 254 and a guide flow channel 258, which will be described below, due to an inner surface thereof. To reduce air resistance of air that flows through flow channels, the inner surface of the distribution guide portion 250 may be curved.

The distribution guide portion 250 may include a guide portion 256.

The guide portion 256 is provided to guide the air that flows into the distribution guide portion 250. The guide flow channel 258 is formed inside the guide portion 256.

The guide portion 256 may include a first guide portion 256*a* and a second guide portion 256*b*.

The first guide portion 256*a* and the second guide portion 256*b* may be divided based on the ejection portion 212 of the first air supply flow channel 210. Based on a longitudinal direction of the guide portion 256, a width becomes narrower from the first guide portion 256*a* to the second guide portion 256*b*. Through the components described above, an amount of the air supplied to the first guide portion 256*a* among an amount of the air supplied from the ejection portion 212 of the first air supply flow channel 210 may be larger than an amount of the air supplied to the second guide portion 256*b*. A width of the second guide portion 256*b* is provided to be smaller than that of the first guide portion 256*a* in the embodiment, but may be modified depending on a product that employs the same.

The first guide portion 256*a* may be provided to form a first guide flow channel 258*a* and to be connected with a first overflow portion 274*a*, which will be described below. The first guide portion 256*a* may be provided to form a first guide flow channel 258*a* and to be connected with a first overflow portion 274*a*, which will be described below. The second guide portion 256*b* may be provided to form a second guide flow channel 258*b*.

The supply guide portion 270 includes the supply portion 272 and the overflow portion 274. The supply guide portion 270 is provided to supply the air that passes through the distribution guide portion 250 to the cooking space 40 or the burner. The supply portion 272 is provided on one side of the distribution guide portion 250 so as to eject air that is mixed with gas that flows into the burner. The supply portion 272 may be provided to be connected with the guide portion 256. In the embodiment, the supply portion 272 is provided to extend from the second guide portion 256*b* and to be connected with the second guide portion 256*b*.

The supply portion 272 may be provided to be spaced at certain intervals along a circumference of a head portion of the burner. Through the components described above, the air that moves to the supply portion 272 among the air guided to the second guide portion 256*b* may be supplied to the head portion of the burner as the primary air or to not flow into the head portion of the burner, but to be supplied to the inside of the cooking space 40 as the secondary air.

The overflow portion 274 is provided to eject air to the cooking space 40. In detail, the overflow portion 274 is provided so as to supply the air guided by the guide portion 256 to the cooking space 40.

The overflow portion 274 may be formed along at least part of a circumference of the first guide portion 256*a*. The overflow portion 274 may be formed as a plurality of holes. The air that flows through the first guide flow channel 258*a* among the air supplied through the ejection portion 212 of the first air supply flow channel 210 may be discharged to the first separate cooking space 41 through the plurality of holes of the overflow portion 274.

Hereinafter, a gas oven in accordance with a third embodiment of the present disclosure will be described.

Repetitive descriptions of components identical to those in the previous embodiments will be omitted.

Figure 12:
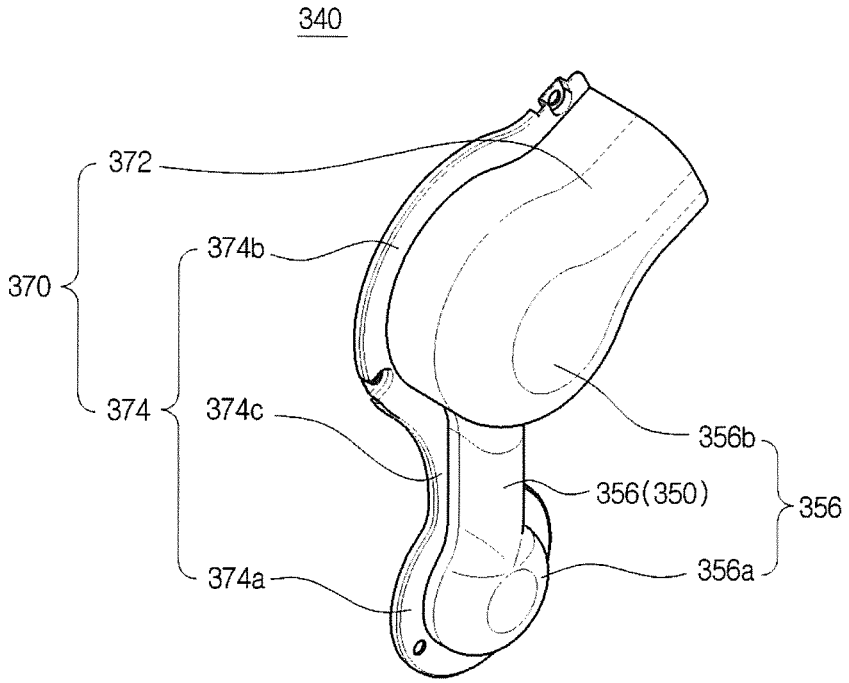
FIGS. 12 and 13 illustrate a distribution unit in accordance with various embodiments of the present disclosure.
Figure 13:
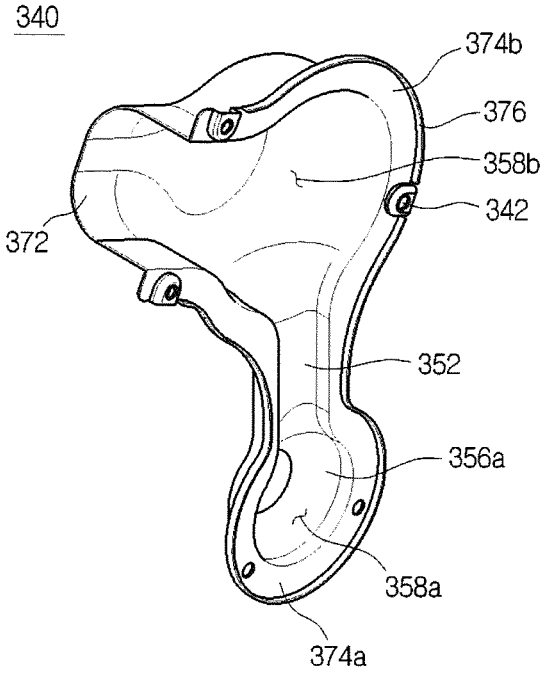
Figure 14:
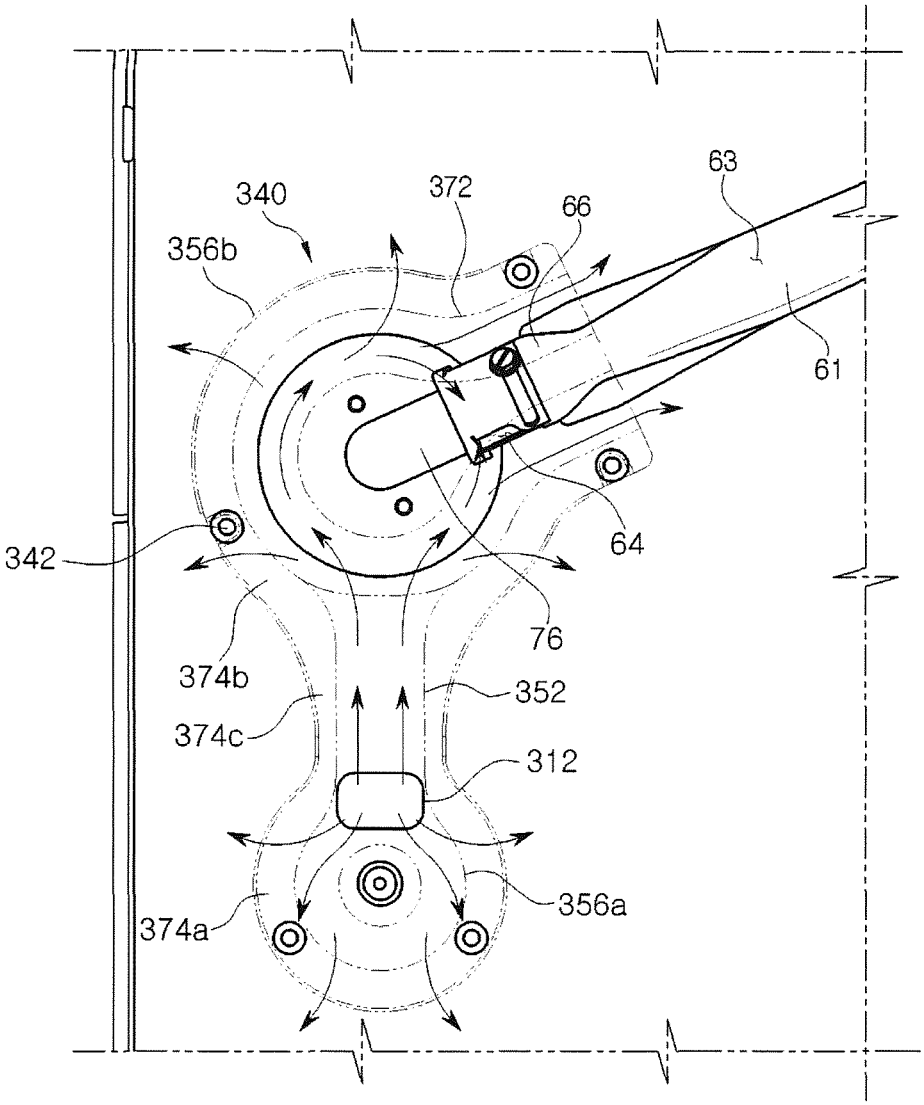
FIG. 14 illustrates an air flow in the distribution unit accordance with various embodiments of the present disclosure.

FIGS. 12 and 13 are perspective views of a distribution unit in accordance with the third embodiment of the present disclosure. FIG. 14 is a view illustrating an air flow in the distribution unit accordance with the third embodiment of the present disclosure.

A distribution unit 340 is provided in an ejection portion 312 of the air supply flow channels 70 and 110 to distribute air supplied through the air supply flow channels 70 and 110. In detail, the distribution unit 340 is disposed in an ejection direction of the ejection portion 312 of the first air supply flow channel 310 to distribute outside air supplied through the first air supply flow channel 310 as a primary air and a secondary air. Also, the secondary air may be efficiently supplied to the first separate cooking space 41 through the distribution unit 340.

The distribution unit 340 may be provided so as to not expose the ejection portion 312 of the air supply flow channels 70 and 110 to the cooking space 40.

That is, the distribution unit 340 may be disposed in the ejection direction of the ejection portion 312, and may be provided so as to not directly expose the ejection portion 312 to the cooking space 40. In detail, the distribution unit 340 is disposed in the ejection direction of the ejection portion 312 to cut off the air ejected from the ejection portion 312. Since the distribution unit 340 is disposed in the (air) ejection direction of the ejection portion 312, heated air formed in the cooking space 40 may be prevented from flowing back toward the ejection portion 312. In the embodiment, since the ejection portion 312 is provided on the rear wall 35, the distribution unit 340 may be disposed in front of the ejection portion 312.

Since the ejection portion 312 of a first air supply flow channel 310 for supplying outside air to the first separate cooking space 41 is disposed on the rear wall 35, the distribution unit 340 is disposed on the rear wall 35 in the embodiment. However, the distribution unit 340 is not limited thereto, and may be disposed in any one of the top wall 31, the bottom wall 32, the left sidewall 33, the right sidewall 34, and the rear wall 35 that form the inner walls of the cooking space 40 depending on a disposition of the first air supply flow channel 310.

The distribution unit 340 may be coupled with the rear wall 35 by a unit coupling portion 342. The unit coupling portion 342 may be provided above an overflow portion 374, which will be described below, and may protrude further than the overflow portion 374 to allow the overflow portion 374 to form an overflow gap 375 between the overflow portion 374 and the rear wall 35.

The distribution unit 340 may include a distribution guide portion 350 and a supply guide portion 370. The air supplied through the first air supply flow channel 310 is passed through the distribution guide portion 350 and may be discharged outside the distribution unit 340 through the supply guide portion 370. That is, the air supplied through the first air supply flow channel 310 may supply the primary air to a burner through the supply guide portion 370 or supply the secondary air to the first separate cooking space 41. The supply guide portion 370 includes a supply portion 372 and the overflow portion 374. The supply guide portion 370 will be described below.

The distribution guide portion 350 is provided to distribute or guide the air supplied through the air supply flow channels 70 and 110. The distribution guide portion 350 may form a distribution flow channel 354 and a guide flow channel 358, which will be described below, due to an inner surface thereof. To reduce air resistance of air that flows through flow channels, the inner surface of the distribution guide portion 350 may be curved.

The distribution guide portion 350 may include a distribution portion 352 and a guide portion 356.

The distribution portion 352 may distribute the air supplied through the first air supply flow channel 310.

The distribution portion 352 may form the distribution flow channel 354 that distributes the air supplied through the ejection portion 312 of the first air supply flow channel 310. The distribution flow channel 354 may include a first distribution flow channel 354*a* that faces downwards and a second distribution flow channel 354*b* that faces upwards. The first distribution flow channel 354*a* may be provided to be guided by a first guide portion 356*a*, which will be described below, to be discharged toward the bottom of the cooking space 40. The second distribution flow channel 354*b* may be provided to be guided by a second guide portion 356*b*, which will be described below, to be discharged toward the middle and the top of the cooking space 40.

The guide portion 356 is provided adjacent to the distribution portion 352 to guide the air distributed from the distribution portion 352. The guide portion 356 is provided to be connected with the distribution portion 352. The guide flow channel 358 connected with the distribution flow channel 354 is formed in the guide portion 356.

The guide portion 356 may include the first guide portion 356*a* and the second guide portion 356*b*.

The first guide portion 356*a* is disposed on one side of the distribution portion 352 and may be disposed closer to the bottom surface of the cooking space 40 than the distribution portion 352. The first guide portion 356*a* forms a first guide flow channel 358*a* in a longitudinal direction parallel to the bottom surface of the cooking space 40. The first guide flow channel 358*a* is provided to be connected with the first distribution flow channel 354*a* described above.

That is, air that flows through the first distribution flow channel 354*a* among the air distributed by the distribution portion 352 may to be guided to the first guide flow channel 358*a*.

A shape of the first guide portion 356*a* is not limited, but may be formed as a hemispherical shape in the embodiment. In detail, the air supplied through the first guide flow channel 358*a* may be discharged to the bottom surface and sides of the cooking space 40 due to a first overflow portion 374*a*, which will be described below. Since the distribution unit 340 is disposed in the first separate cooking space 41 in the embodiment, the air supplied through the first guide flow channel 358*a* and the first overflow portion 374*a* may be supplied to the top surface 43*a* of the divider 43, the left sidewall 33, and the right sidewall 34 in the first separate cooking space 41. As described below, since the first overflow portion 374*a* is formed along a circumference of the first guide portion 356*a*, the air guided through the first guide flow channel 358*a* of the first guide portion 356*a* may be discharged not only to the bottom surface and sides of the cooking space 40, but also to the top of the cooking space 40.

The second guide portion 356*b* is disposed on the other side of the distribution portion 352. The second guide portion 356*b* forms a second guide flow channel 358*b*. The second guide flow channel 358*b* is provided to be connected with the second distribution flow channel 354*b* described above.

That is, air that flow through the second distribution flow channel 354*b* among the air distributed by the distribution portion 352 may be guided by the second guide flow channel 358*b*.

The second guide portion 356*b* is disposed above the distribution portion 352 to guide part of the air distributed by the distribution portion 352 to the supply portion 372 and a second overflow portion 374*b*, which will be described below.

A shape of the second guide portion 356*b* is not limited, and may be formed as a hemispherical shape in the embodiment. In detail, the air supplied through the second guide flow channel 358*b* may be discharged to the top and sides of the cooking space 40 due to the second overflow portion 374*b*, which will be described below. Since the distribution unit 340 is disposed in the first separate cooking space 41 in the embodiment, the air supplied through the second guide flow channel 358*b* and the second overflow portion 374*b* may be supplied to the top wall 31, the left sidewall 33, and the right sidewall 34 of the first separate cooking space 41. As described below, since the second overflow portion 374*b* is formed along a circumference of the second guide portion 356*b*, the air guided through the second guide flow channel 358*b* of the second guide portion 356*b* may be discharged not only to the top and both sides of the cooking space 40, but also to the bottom of the cooking space 40.

The supply guide portion 370 includes the supply portion 372 and the overflow portion 374. The supply guide portion 370 is provided to supply the air that passes through the distribution guide portion 350 to the cooking space 40 or the burner. The supply guide portion 370 may be formed on the inner wall along the whole circumference of the distribution guide portion 350. Since the distribution unit 340 and the ejection portion 312 are disposed at the rear wall 35, the supply guide portion 370 may be formed on the rear wall 35 along the whole circumference of the distribution guide portion 350. Since the air guided by the distribution guide portion 350 is discharged through the supply guide portion 370 formed on the whole reference of the distribution guide portion 350, the air heated in the cooking space 40 may be prevented from flowing back into the distribution guide portion 350 through the supply guide portion 370.

The supply guide portion 370 is provided to be formed along the whole area of the circumference of the distribution guide portion 350 in the embodiment but may be formed in part thereof.

The supply portion 372 is provided on one side of the distribution guide portion 350 so as to eject air that is mixed with gas that flows into the burner. The supply portion 372 may be provided to be connected with the guide portion 356. In the embodiment, the supply portion 372 is provided to extend from the second guide portion 356*b* and to be connected with the second guide portion 356*b*.

The supply portion 372 may be provided to be spaced at certain intervals along a circumference of a head portion of the burner. Through the components described above, the air that moves to the supply portion 372 among the air guided to the second guide portion 356*b* may be supplied to the head portion of the burner as the primary air or to not flow into the head portion of the burner, but to be supplied to the inside of the cooking space 40 as the secondary air.

The overflow portion 374 is provided to eject air to the cooking space 40. In detail, the overflow portion 374 is provided so as to supply the air guided by the guide portion 356 to the cooking space 40. The overflow portion 374 is formed along at least a part of the circumference of the distribution guide portion 350 to eject the air to the cooking space 40. The overflow portion 374 may be formed as a shape of a surface that faces the rear wall 35 along the at least a part of the circumference of the distribution guide portion 350 with certain widths. To uniformly supply the secondary air from the distribution unit 340 to the cooking space 40 in various directions, the overflow portion 374 may be formed with the certain widths. However, it is not limited thereto, the width of the overflow portion 374 may be different in some sections as necessary.

The overflow portion 374 may be formed to be spaced apart from the inner wall of the cooking space 40. In detail, since the distribution unit 340 is disposed on the rear wall 35 of the cooking space 40, the overflow portion 374 may be formed to be spaced at a certain interval from the rear wall 35. The interval between the overflow portion 374 and the rear wall 35 is provided to be smaller than an interval between the guide portion 356 and the rear wall 35.

The overflow portion 374 may include the overflow gap 375. The overflow gap 375 is provided between the overflow portion 374 and the rear wall 35 so as to flow the air guided by the guide portion 356.

The overflow portion 374 may further include an overflow rib 376. The overflow rib 376 is formed along an outer edge of the overflow portion 374, and is provided to be bent from the outer edge toward the inner wall. The overflow gap 375 may include a first overflow gap 375 formed between the overflow portion 374 and the rear wall 35, and a second overflow gap 375 formed between the overflow rib 376 and the rear wall 35.

Since an end of the overflow rib 376 is provided closer to the rear wall 35 than the overflow portion 374, the second overflow gap 375 is formed to be smaller than the first overflow gap 375.

Through the components described above, the air in the cooking space 40 may be prevented from flowing back toward the guide portion 356 through the overflow portion 374 while the air guided through the guide portion 356 is discharged to the cooking space 40 through the overflow portion 374.

The overflow portion 374 may include the first overflow portion 374*a* formed along at least part of the circumference of the first guide portion 356*a* and the second overflow portion 374*b* formed along at least part of the circumference of the second guide portion 356*b*. Also, the overflow portion 374 may further include a third overflow portion 374*c* formed along at least part of a circumference of the distribution portion 352.

Hereinafter, a gas oven in accordance with a fourth embodiment of the present disclosure will be described.

Repetitive descriptions of components identical to those in the previous embodiments will be omitted. In the embodiment, a distribution unit 440 that includes some components different from the distribution unit 140 in accordance with the first embodiment will be described.

Figure 15:
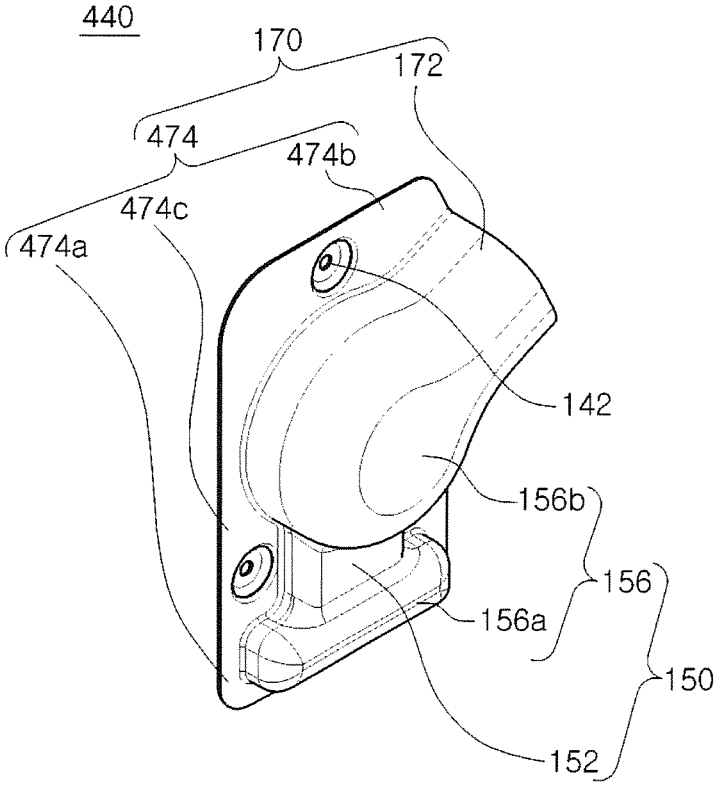
FIGS. 15 and 16 illustrate a distribution unit in accordance with various embodiments of the present disclosure.
Figure 16:
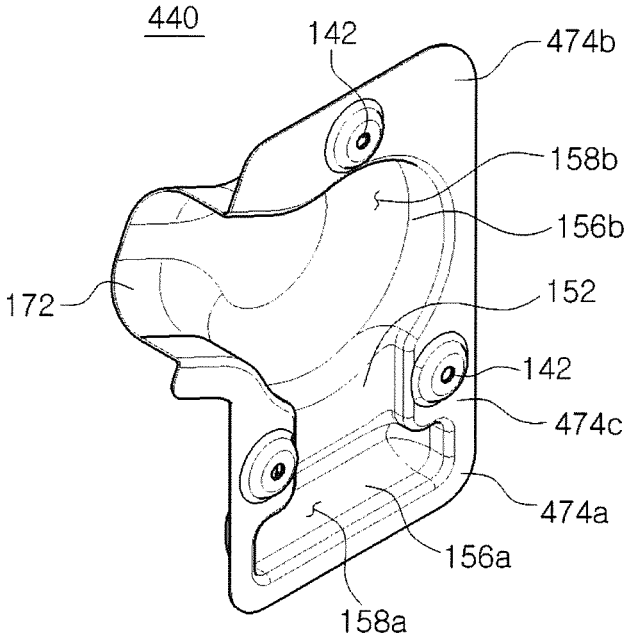
Figure 17:
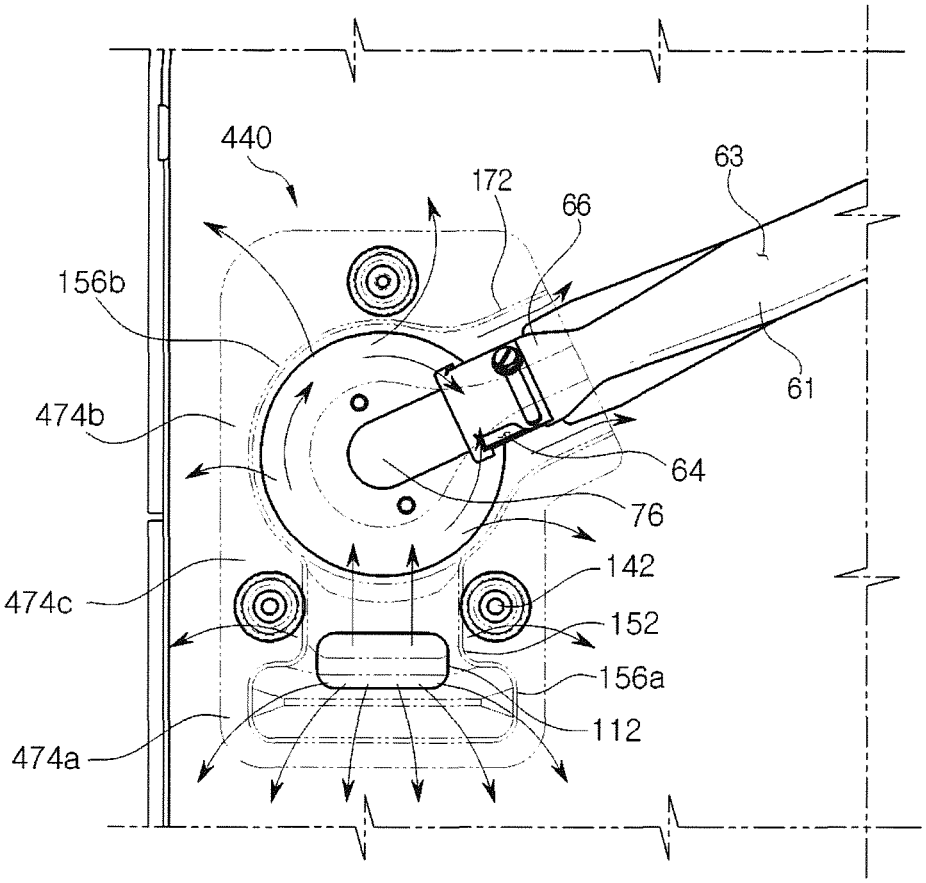
FIG. 17 illustrates an air flow in the distribution unit accordance with various embodiments of the present disclosure.

FIGS. 15 and 16 are perspective views of the distribution unit 440 in accordance with the fourth embodiment of the present disclosure. FIG. 17 is a view illustrating an air flow in the distribution unit 440 accordance with the fourth embodiment of the present disclosure.

In the embodiment, an overflow portion 474 is provided having a shape of a surface that faces the rear wall 35 along the circumference of the distribution guide portion 150. The overflow portion 474 is provided in an approximate quadrangular shape on the circumference of the distribution guide portion 150.

Also, in the embodiment, the overflow rib 176 in accordance with the first embodiment is omitted in the overflow portion 474. Through the components described above, an overflow gap 475 formed between the overflow portion 474 and the rear wall 35 may be formed to be smaller. However, it is not limited thereto, the overflow rib 176 may be applied regardless.

The overflow portion 474 may include a first overflow portion 474*a* formed along at least part of the circumference of the first guide portion 156*a*, and a second overflow portion 474*b* formed along at least part of the circumference of the second guide portion 156*b*. Also, the overflow portion 474 may further include a third overflow portion 474*c* formed along at least a part of the circumference of the distribution portion 152.

As is apparent from the above description, a gas oven in accordance with one embodiment of the present disclosure can efficiently supply air to a cooking space divisibly provided.

Also, the gas oven distributes supplied air and can efficiently supply primary air and secondary air necessary for combustion.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A gas oven comprising:

a body;

a cooking space formed in the body;

a burner provided in the cooking space;

an inner wall configured to form the cooking space;

an air supply flow channel configured to connect the cooking space with an outside of the body to supply external air from the outside of the body to the cooking space; and a distribution unit provided at an ejection portion of the air supply flow channel, the ejection portion of the air supply flow channel formed in the inner wall and the distribution unit formed within the cooking space on the inner wall and configured to distribute the external air supplied through the air supply flow channel, wherein the distribution unit comprises:

a distribution guide portion configured to distribute the external air supplied through the air supply flow channel; and a supply guide portion configured to guide the external air that passes through the distribution guide portion to be supplied to one of the cooking space and the burner, wherein the supply guide portion is formed on the inner wall along a whole circumference of the distribution guide portion, so that the distribution unit is configured to bend a flow of the external air supplied through the air supply flow channel to supply the air to the cooking space along the inner wall.

2. The gas oven of claim 1, wherein the external air supplied through the air supply flow channel passes through the distribution guide portion and is discharged outside the distribution unit through the supply guide portion.

3. The gas oven of claim 1, wherein the distribution unit is disposed in an ejection direction of the ejection portion of the air supply flow channel so as to not expose the ejection portion to the cooking space.

4. The gas oven of claim 1, wherein the distribution guide portion comprises:

a distribution portion configured to distribute the external air supplied through the air supply flow channel; and a guide portion provided adjacent to the distribution portion and configured to guide the external air distributed from the distribution portion.

5. The gas oven of claim 4, wherein the distribution portion is formed closer to the inner wall than the guide portion.

6. The gas oven of claim 4, wherein the guide portion comprises a first guide portion disposed on one side of the distribution portion, is disposed closer to a bottom surface of the cooking space than the distribution portion, and is configured to form a first guide flow channel in a longitudinal direction parallel to the bottom surface of the cooking space.

7. The gas oven of claim 6, wherein the guide portion further comprises a second guide portion disposed on another side of the distribution portion and configured to form a second guide flow channel to be connected with the supply guide portion.

8. The gas oven of claim 7, wherein the supply guide portion comprises:

a supply portion provided on one side of the distribution guide portion and configured to eject air that is mixed with gas that flows into the burner; and an overflow portion formed along at least a part of a circumference of the distribution guide portion and configured to eject air to the cooking space, and wherein the overflow portion comprises:

a first overflow portion formed along at least part of a circumference of the first guide portion; and a second overflow portion formed along at least part of a circumference of the second guide portion.

9. The gas oven of claim 1, wherein an inner surface of the distribution guide portion is formed to be curved to reduce pneumatic resistance of the air that passes through an inside of the distribution guide portion.

10. The gas oven of claim 1, wherein the supply guide portion comprises:

a supply portion provided on one side of the distribution guide portion and configured to eject air that is mixed with gas that flows into the burner; and an overflow portion formed along part of a circumference of the distribution guide portion and configured to eject air to the cooking space.

11. The gas oven of claim 10, wherein the supply portion is formed to extend from the distribution guide portion and to be spaced at certain intervals along a circumference of a head portion of the burner.

12. The gas oven of claim 10, comprising an inner wall configured to form the cooking space therein, wherein the overflow portion comprises an overflow gap formed to be spaced at a certain interval from the inner wall and is formed along the circumference of the distribution guide portion.

13. The gas oven of claim 12, wherein the overflow portion further comprises an overflow rib formed along an outer edge of the overflow portion to be bent toward the inner wall.

14. The gas oven of claim 1, wherein the cooking space comprises a first separate cooking space on top and a second separate cooking space on bottom, and is provided to be dividable into the first separate cooking space and the second separate cooking space by a divider, wherein the burner comprises:

a first burner provided in the first separate cooking space; and a second burner provided in the second separate cooking space, wherein the air supply flow channel comprises:

a second air supply flow channel configured to connect the second separate cooking space with the outside of the body and to supply external air to the second separate cooking space; and a first air supply flow channel configured to connect the first separate cooking space with the outside of the body to supply external air to the first separate cooking space, and wherein the distribution unit is disposed at the ejection portion of the first air supply flow channel.

15. A gas oven comprising:

a body;

one cooking space dividable into a first separate cooking space on top and a second separate cooking space on bottom by a divider separably mounted in the one cooking space;

an inner wall configured to form the cooking space;

one door configured to open and close the cooking space;

a first burner provided in the first separate cooking space;

a second air supply flow channel configured to connect the second separate cooking space with an outside of the body to supply external air from the outside of the body to the second separate cooking space;

a first air supply flow channel configured to connect the first separate cooking space with the outside of the body to supply external air from the outside of the body to the first separate cooking space, and a distribution unit provided at an ejection portion of the first air supply flow channel, the ejection portion of the first air supply flow channel formed in the inner wall and the distribution unit formed within the first separate cooking space on the inner wall and configured to distribute the external air supplied from the first air supply flow channel to an inside of the first separate cooking space, the distribution unit comprising;

a distribution guide portion configured to distribute the external air supplied through the first air supply flow channel; and a supply guide portion configured to guide the external air that passes through the distribution guide portion to supply the external air to one of the cooking space and the first burner, wherein the supply guide portion is formed on the inner wall along a whole circumference of the distribution guide portion, so that the distribution unit is configured to bend a flow of the external air supplied through the first air supply flow channel to supply the external air to the cooking space along the inner wall.

16. The gas oven of claim 15, wherein the distribution unit is further configured to distribute the external air supplied from the first air supply flow channel that is mixed with gas supplied to the first burner.

17. The gas oven of claim 16, wherein the distribution unit is disposed in an ejection direction of the ejection portion of the first air supply flow channel so as to not expose the ejection portion to the cooking space.

18. The gas oven of claim 15, wherein the external air supplied through the first air supply flow channel passes through the distribution guide portion and is discharged outside the distribution unit through the supply guide portion.

19. The gas oven of claim 15, wherein the supply guide portion is formed on the inner wall along a whole circumference of the distribution guide portion.

* * * * *